United States Patent [19]

Williams, Jr.

[11] Patent Number: 4,856,984

[45] Date of Patent: Aug. 15, 1989

[54] TIME-DELAY FOR AUTOMATIC RESET OF FURNACE

[75] Inventor: Roger W. Williams, Jr., Springfield, Mass.

[73] Assignee: R. E. Phelon Company, Inc., East Longmeadow, Mass.

[21] Appl. No.: 321,843

[22] Filed: Mar. 10, 1989

[51] Int. Cl.[4] ..... F23N 5/00

[52] U.S. Cl. ..... 431/30; 431/69; 110/192

[58] Field of Search ..... 236/11, 46 E, 46 F; 110/192, 162; 431/69, 70, 27

[56] References Cited

U.S. PATENT DOCUMENTS

| | | | |
|---|---|---|---|
| 3,433,572 | 3/1969 | Giuffrida | 431/69 X |
| 4,137,035 | 1/1979 | Cade | 431/29 X |
| 4,325,689 | 4/1982 | Burke | 431/70 |
| 4,773,586 | 9/1988 | Ryan | 236/11 |

*Primary Examiner*—William E. Wayner

*Attorney, Agent, or Firm*—Chapin, Neal & Dempsey

[57] ABSTRACT

Automatic reset for an unattended gas furnace has an induced draft blower motor energized by an electrical power source and with a first, normally "open", relay switch in circuit to control the operation of the blower motor. A burner control circuit, energized by a transformer coupled portion of the power source, has a room thermostatic switch, a second, normally "open", relay switch in series with the thermostatic switch and an air-flow switch operated by airflow in the furnace to connect the control circuit to the second power source when the blower is "on" and the thermostat is "closed", calling for heat. The second switch is connected to the control electrode of an electronic switching element to energize selectively a relay controller which, when energized, closes both the first and second relay switches to energize the blower motor and burner control circuit. A timer, having a predetermined time interval, is connected to energize a second electronic switching element connected to shunt energy from the first electronic switching element to deenergize the relay controller after elapse of the time interval to enable the two relay switches to "open", thereby cutting "off" the blower and burner to automatically reset the furnace from a lockout condition.

5 Claims, 1 Drawing Sheet

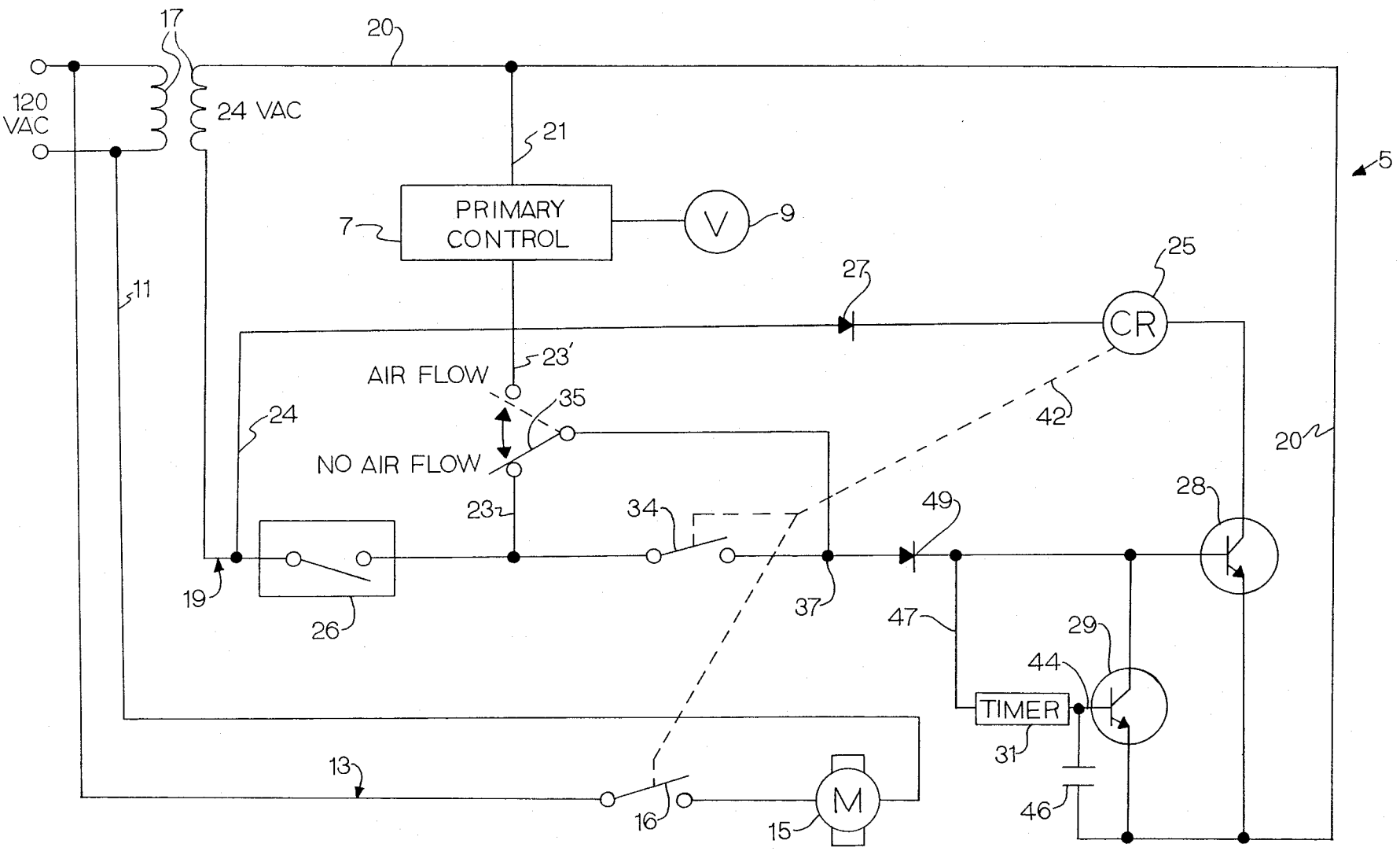
5
20
28
25
CR
29
44
TIMER
31
46
42
49
47
27
37
M
15
9
V
34
16
21
PRIMARY CONTROL
23'
35
23
AIR FLOW
NO AIR FLOW
7
26
13
24 VAC
24
19
17
11
120 VAC

TIME-DELAY FOR AUTOMATIC RESET OF FURNACE

BACKGROUND OF THE INVENTION

This invention relates generally to a control circuit for a gas furnace which automatically resets itself when it is in a lockout condition by timing the length of time that the thermostat has been "closed" and calling for heat.

U.S. Pat. No. 4,325,689 to Burke discloses a furnace reset which directly senses that the flame is extinguished and a timer is employed to delay the "re-light" attempt until a predetermined time interval after the flame has gone out to prevent a hazardous condition.

U.S. Pat. No. 4,773,586 to Ryan shows a safety sense element 28 which energizes the blower relay of the furnace when a high furnace temperature causes limit thermostat 18 to "open". But, no means is provided for automatic reset of the furnace after a lockout has occurred.

The principal object of this invention is to automatically reset an unattended gas furnace when the primary control of the furnace has gone into a lockout condition for a predetermined time duration.

Another object of this invention is to provide an electrical circuit for a furnace which automatically monitors the furnace control and simulates the effect of manually resetting or lowering the thermostat to reset the furnace control from a lockout condition.

Still another object of this invention is to ensure that unattended furnaces which have gone into a lockout condition will not be left in that condition for an extended period of time with the potential in winter of the water freezing and bursting the pipes with potential of damage to the unattended space and its contents.

A further object of this invention is to provide means for resetting a furnace from a locked out state which does not depend upon the direct sensing of the burner flame, but rather simulates the effect of resetting the thermostat.

The above and other objects and advantages of this invention will be more readily apparent from the following description read in conjunction with the accompanying drawings, in which:

The FIGURE shows an electrical schematic diagram of an automatic reset system of the type embodying this invention.

The circuit shown generally at 5 is designed to automatically reset the furnace control 7 from a "lockout" condition after a predetermined time interval.

A "lockout" occurs when, for some reason, the burner flame goes out when the thermostat is "closed" and calling for heat. Since the room temperature will, at that time, be lower than the temperature set on the space thermostat, the thermostat will remain "closed" until it is reset. This is done by first lowering the temperature below the room temperature and then resetting the thermostat to the desired room temperature. When this is done, the lockout condition in the burner control will be cleared and the system can be cycled "on", the thermostat again calling for heat. Of course, the thermostat cannot be reset in this manner if the furnace is left unattended for any extended period of time, as when home owners are away on vacation or the like.

The furnace control system 5 of the present invention automatically interrupts the power supply to the primary control 7 when the timer 31 determines that the thermostat has been calling for heat for a predetermined period of time, such as two, three or four hours, for example.

Electrical energy, such as 120 volts, alternating current for the entire circuit 5, is supplied at source 11 which directly powers circuit 13 containing the furnace blower 15, such as an induced draft blower energized by a normally "open" relay switch 16. A step-down transformer 17 provides power, such as 24 volts A.C., to the burner circuit which includes conductors 19 and 20. The circuit includes a room or space thermostat 26, of a conventional type, primary burner control 7 and associated fuel control valve 9. The system also includes lead wires 21 and 23 which supply electrical power to the primary control system via thermostat 26, relay switch 34 and an airflow switch 35 when in its up position and connected to lead 23'. The airflow switch 35 is either a pressure or vacuum operated switch which in normally lower position, provides a current path in parallel with switch 34 to junction 37. When the blower is providing air to the furnace chamber, not shown, the air switch will be shifted to its upper position.

Air switch 35 will thus either be connected to lead 23 or to lead 23', depending upon whether blower 15 is producing any airflow through the heat exchanger of the furnace.

An electric conductor 24 connects the energy source from lead 19, connected between the power supply and the thermostat 26, through a diode 27 to a relay driver or control unit 25 which, when energized, will "close" relay switch 16 and relay switch 34. The relay drive circuit is completed through a solid state electronic switching means, such as the collector and emitter electrodes of an NPN transistor 28 back to transformer 17 via conductor 20. When the base of transistor 28 is biased to provide base-emitter current, transistor 28 will be turned "on" whereby relay control 25 is energized, "closing" switches 16 and 34, as will hereafter be more fully described.

Means to shunt base current from the transistor 28 to turn "off" the same and thereby, deenergize relay control 25 comprises NPN transistor 29 having its base connected to a timer 31 by conductor 44. A capacitor 46 is connected across the base-emitter electrodes of transistor 29 and serves to hold "on" the transistor 29 for a time interval equal to or longer than the maximum lockout time, typically ninety (90) seconds, to ensure the complete opening of switches 34 and 16 in order to reset the primary burner control. A lead 47 provides the input energy to the timer 31 via diode 49 and junction 50.

The timer 31 and transistor 29 provide a shunt path to turn "off" transistor 28 whenever the timer puts out a voltage pulse to turn "on" transistor 29 after the predetermined interval selected for the operation of timer 31. In this system, a two (2) hour time interval has been found acceptable but it will be understood that, within the scope of this invention, any other time interval may be used. In any case, the timer which may be a computer chip, an electronic or mechanical timer, is energized to start its time measuring function each time the thermostat 26 and relay switch 34 are "closed". A suitable timer chip for use in this system may be Motorola Chip Model No. MC.14541 BCB. The timer will generate an output after the preselected time interval to initiate operation of the reset function. In the meantime, however, transistor 28 will be in its conductive energizing relay control 25.

The primary control of this invention may be reset either by manually "opening" thermostat which 21 or automatically by the timer 31 "opening" relay switch 34, as will be more fully described below. One type of burner control for use in practicing this invention is a gas primary burner control, marketed by Minneapolis Honewell as Model No. S86H1006.

OPERATION

When the thermostat 26 is "closed" and first calls for heat, air switch 35 will be in its lower position, as seen in FIG. 1. In this position, current will be supplied to the base of transistor 28, energizing the transistor. Current will then be flowing through relay controller 25 which closes both the normally "open" relay switch 34 and normally "open" blower relay switch 16. The "closing" of relay switch 34 provides a second and parallel current path to transistor 28 and timer 31. "Closing" the blower relay switch 16, will start the blower 15 and cause the air switch to move to its upper position whereby current then flows to the primary control 7 through thermostat 26, relay switch 34, switch 35 and lead 23'. The other side of the primary control is connected to the power source by leads 20 and 21. As a result, the fuel valve 9 will be "opened" to supply fuel to the burner. This is the state of the furnace during normal operation and each time the thermostat "closes," the timer 31 will be energized to start another timing cycle.

Whenever the thermostat 21 is calling for heat, the furnace may either be operating normally or in some rare instances, the primary control may be in a lockout condition. When the furnace is operating normally, the room temperature will rise and the thermostat will be satisfied and "open" or stop calling for heat. However, if the control is in a lockout condition, thermostat 26 will remain "closed", calling for heat, as the room temperature continually drops until the primary control is reset. It is reasonable to assume that if thermostat 26 calls for heat for an extended time period, such as two (2) hours or more without being satisfied by increasing room temperatures, that a lockout condition will have occurred in the furnace.

The basis of this invention is, that when the furnace is in a lockout state, thermostat 26 will be calling for heat and relay switches 16 and 34 will be "closed" since transistor 28 will be in its conductive mode, energizing relay controller 25. As previously mentioned, timer 31 will start and run continually each time the thermostat is "closed", supplying current to junction 50 and will be reset whenever thermostat 26 "opens", which occurs only when thermostat 26 is not calling for heat or when both relay switch is "open" and air switch 35 is in its up or "airflow" position.

Whenever the timer runs for its predetermined time interval, then the timer will operate in the following manner: The timer output via conductor 44 charges capacitor 46 and by current supplied to its base, transistor 29 will be turned "on" and thereby shunts the base current from transistor 28 to turn "off" the latter transistor for the maximum lockout time, generally about ninety (90) seconds. When transistor 29 is turned "on", current to the base of transistor 28 is shunted to lead 20, thereby cutting "off" transistor 29 and deenergizing control relay 25.

By deenergizing relay control 25, relay switch 34 and switch 16 will "open" and blower 15 will stop running. The air switch 35 will be returned to its lower position and no current will flow to the primary control, thereby resetting the primary control 7 from its lockout condition. The effect is the same as having manually "opened" the thermostat.

This system is especially adaptable to gas-fired furnaces, but may be applied to other type furnaces as well. It is also noted that while the control means for relay 25 is illustrated as transistors 27 and 29, other suitable solid state switching devices may be used without departing from the scope of this invention.

Having thus described my invention, what is claimed is:

1. An automatic reset for a furnace control which includes a power source connected by relay contacts to a fan motor in response to operation of a relay controller, an airflow switch pneumatically operated in response to airflow from the fan within said furnace, a primary burner control for operating the fuel valve of said furnace, a space thermostat to selectively supply energy to the primary burner control and relay controller in response to the temperature sensed by said thermostat, said automatic reset comprising a relay switch and airflow switch connected in a parallel circuit and in series with said thermostat, first electronic switching means for energizing said relay controller and connected to be actuated by said energy source by closure of either the relay switch or the airflow switch, timing means connected in circuit with said parallel circuit and providing an alternate circuit path for shunting the energy which actuates said first switching means to thereby deenergize said relay controller to "open" said relay switch and said relay contacts so that the fan motor and primary burner control are "cut off", whereby the burner control is automatically reset.

2. Automatic reset for a furnace control, as set forth in claim 1, in which the timing function of the timing means is actuated each time the thermostat is "closed", the output of said timing means including a second electronic switching means connected to turn "off" the first switching means.

3. Automatic reset for a furnace control, as set forth in claim 2, in which said first switching means comprises a transistor having a base, collector and emitter electrodes, the base thereof being connected to the timing means.

4. Automatic reset for a furnace control, as set forth in claim 1, in which said second switching means comprises a second transistor having base, emitter and collector electrode, the emitter and collector electrode of the second transistor providing a shunt path connected from the base of the first transistor and the base of said second transistor being connected to the output of the timing means.

5. Automatic reset for a furnace control, as set forth in claim 1, in which a capacitor is connected across base and emitter of said second transistor and the output of the timing means to maintain a bias on the base of said second transistor to hold the same "on" for a time interval to ensure the "opening" of the relay contacts and relay switch, whereby to reset the furnace control.

* * * * *